US010750839B2

(12) United States Patent
Havlovick

(10) Patent No.: US 10,750,839 B2
(45) Date of Patent: Aug. 25, 2020

(54) REPLACEABLE MANUAL PUMP HEATING PERSONAL FLUID DISPENSER

(71) Applicant: Ronald G. Havlovick, Plano, TX (US)

(72) Inventor: Ronald Gene Havlovick, Plano, TX (US)

( * ) Notice: Subject to any disclaimer, the term of this patent is extended or adjusted under 35 U.S.C. 154(b) by 0 days.

(21) Appl. No.: 16/355,805

(22) Filed: Mar. 17, 2019

(65) Prior Publication Data

US 2019/0208888 A1 Jul. 11, 2019

Related U.S. Application Data

(63) Continuation-in-part of application No. 15/299,657, filed on Oct. 21, 2016, now abandoned.

(51) Int. Cl.
*A45D 34/00* (2006.01)

(52) U.S. Cl.
CPC ..... *A45D 34/00* (2013.01); *A45D 2200/056* (2013.01); *A45D 2200/155* (2013.01)

(58) Field of Classification Search
CPC ..... B67D 7/32; B67D 7/82; A45D 34/00
USPC ..... 222/52, 146.1, 146.2, 146.3, 146.5
See application file for complete search history.

(56) References Cited

U.S. PATENT DOCUMENTS 3,207,369 A * 9/1965 Rossi ..... B65D 83/72 222/23
4,027,786 A * 6/1977 Ryckman, Jr. ..... B65D 83/384 222/146.3
4,056,707 A * 11/1977 Farnam ..... A45D 40/00 392/466
4,067,480 A * 1/1978 Gasser ..... B65D 83/72 222/146.3
4,069,949 A * 1/1978 Ryckman, Jr. ..... B65D 83/384 222/146.3
6,311,868 B1 * 11/2001 Krietemeier ..... A45D 34/00 222/1
6,415,957 B1 * 7/2002 Michaels ..... A45D 27/02 219/214
6,655,552 B2 * 12/2003 Aiken ..... B65D 83/206 222/146.3
6,978,912 B2 * 12/2005 Taylor ..... B65D 83/72 222/146.3
8,056,764 B2 * 11/2011 Paasch ..... G01F 11/028 219/433
8,240,933 B2 * 8/2012 Skalitzky ..... A45D 34/00 222/146.5

(Continued)

*Primary Examiner* — Vishal Pancholi

(57) ABSTRACT

A Replaceable Manual Pump Heating Personal Fluid Dispenser that instantaneously heats personal fluid as the fluid flows through a tube or tubes integral to the dispenser, replacing the off-the-shelf personal fluid plastic bottle or container's actuator, closure, pump, and intake assembly to one that mimics the same yet allows heating of the personal fluid, uses the standard mass produced off-the-shelf plastic bottle or container for the storage of the personal fluid, and thereby is inexpensive to the user, safe, and eliminates the need for any special apparatus, or cartridge, to hold the personal fluid, or require the personal fluid to be removed from the plastic bottle or container in order for the personal fluid to be heated, and ensures no chemical leaching into the personal fluid from prolonged heating of the personal fluid when in contact with the plastic personal fluid bottle or container.

20 Claims, 4 Drawing Sheets

(56) References Cited

U.S. PATENT DOCUMENTS

2015/0265107 A1* 9/2015 Buckalter ..... A47K 5/1211
222/63

* cited by examiner

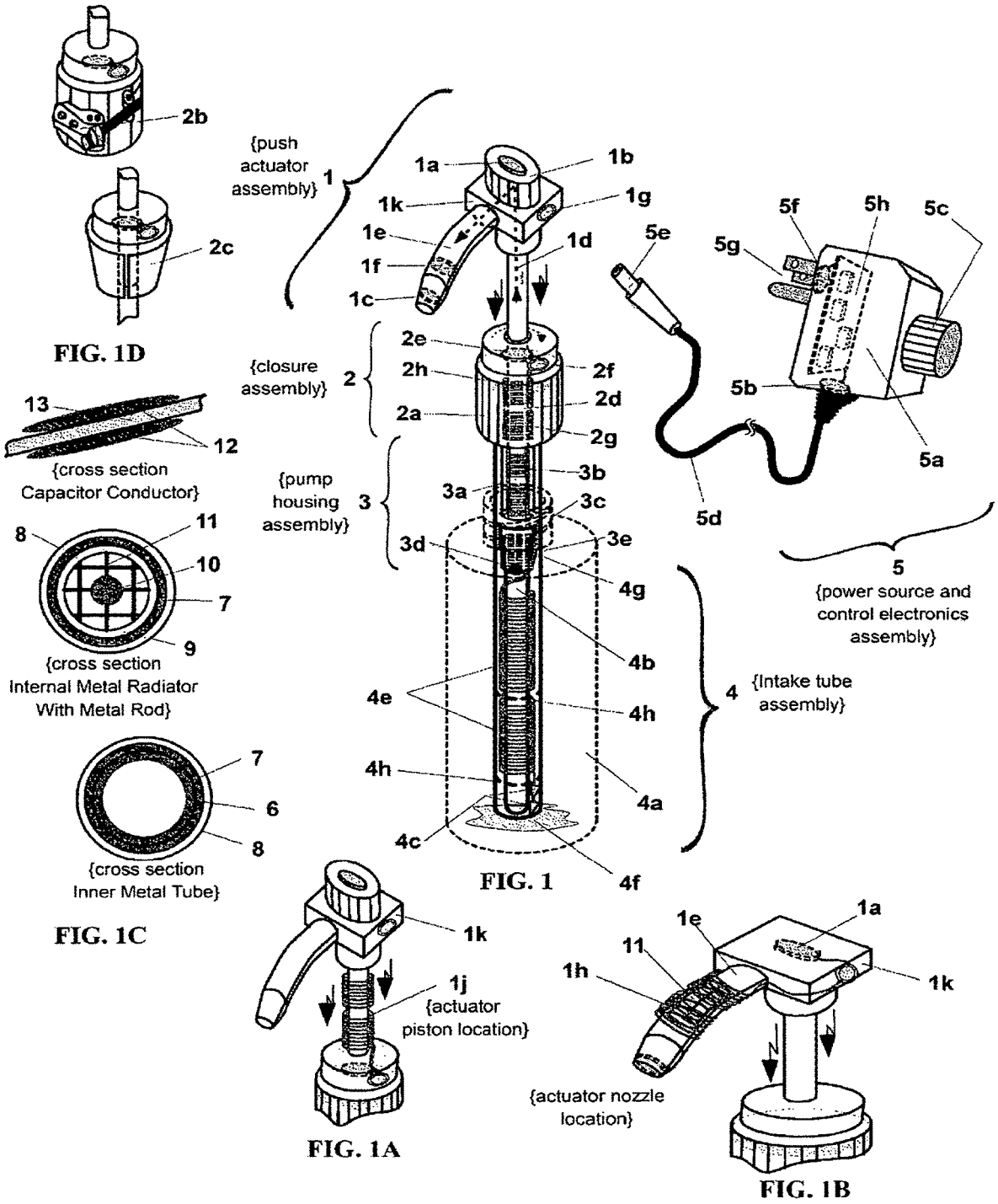
2b
2c
FIG. 1D
13
12
{cross section
Capacitor Conductor}
8
11
10
7
9
{cross section
Internal Metal Radiator
With Metal Rod}
7
6
8
{cross section
Inner Metal Tube}
FIG. 1C
{push
actuator
assembly} 1
1a
1b
1k
1g
1e
1d
1f
1c
{closure
assembly} 2
2e
2h
2f
2d
2a
2g
{pump
housing
assembly} 3
3b
3a
3c
3d
3e
4g
4b
4e
4h
4h
4a
4c
4f
4 {Intake tube
assembly}
5e
5f
5h
5c
5g
5b
5a
5d
5
{power source and
control electronics
assembly}
FIG. 1
1k
1j
{actuator
piston location}
FIG. 1A
1e
1a
11
1h
1k
{actuator nozzle
location}
FIG. 1B

REPLACEABLE MANUAL PUMP HEATING PERSONAL FLUID DISPENSER

FIELD OF INVENTION

The present invention relates to manual pump personal fluid dispensers that heat personal fluid as the personal fluid flows through a tube and more particularly to a replaceable manual pump personal fluid dispenser which heats the personal fluid as the personal fluid flows through a tube integral to the dispenser.

BACKGROUND

In the most common personal lotion or gel or liquid dispensers, hence personal fluid dispensers, as an example, a hand lotion dispenser, the bottle or container holding the personal fluid, is uniformly round or oval, and the personal lotion or gel or liquid, personal fluid, is dispensed by a manual pump using a push actuator. By the user manually pushing the actuator downward, the personal fluid is pumped through a tube, either singular or a multitude of tubes, and dispensed onto the user's hand or body, hence, a manually operated pump personal fluid dispenser.

The most common method means to attach this manually operated pump personal fluid dispenser to the personal fluid bottle or container is a screw cap, plug cap, or snap cap, or as industry refers to them, a screw closure or plug fit closure or snap fit closure, or in general, a closure.

The most common personal fluid bottle or container composition is made of plastic. The most common type of this plastic is PolyEthylene Terephthalate plastic or PET.

And, most commonly, the personal fluid is not heated because the personal fluid bottle or container is made of plastic, PET, and according to Scientific Publications, *Journal of Environmental Monitoring, Environmental Health Perspectives*, prolonged heating of the personal fluid in contact with the plastic bottle or container, PET, may cause types of chemicals to leach out of the plastic, PET, and into the personal fluid which may be harmful to the user.

Present art, which allows heating of personal fluid, suffers from several disadvantages:

In present art, in order to heat the personal fluid, an attachment is placed onto or atop the personal fluid bottle or container and the user must endure a prolonged period of time to allow the entire personal fluid bottle or container to heat and transfer this heat into the entire volume of the personal fluid before dispensing the heated personal fluid.

Still in other present art, a heating element or means is inserted into the personal fluid within the personal fluid bottle or container and the user must endure a prolonged period of time to heat the entire volume of the personal fluid within the bottle or container before dispensing the heated personal fluid.

Still in other present art, the personal fluid has to be removed from its plastic bottle or container and poured into or placed within another apparatus or container and the user must endure a prolonged period of time to heat the entire volume of the personal fluid before dispensing the heated personal fluid.

Still in other present art, the personal fluid bottle or container must be placed within a water or other liquid based bath, and this water or liquid bath is then heated by some means and the user must endure a prolonged period of time to heat the water or liquid bath, then transfer this heat through the bottle or container to heat the volume of personal fluid before dispensing the heated personal fluid.

Still in other present art, the personal fluid bottle or container must be of a special size, a certain circular dimension, in order to fit into the heating apparatus, such that the plastic bottle or container is then heated and the user must endure a prolonged period of time for the heated bottle or container to transfer this heat into the personal fluid.

Still in other present art, the personal fluid must be urged into a holding reservoir by some means, by which the personal fluid becomes stagnant within the reservoir and thereby allows personal fluid heating, and the user must endure a prolonged period of time to allow this holding reservoir to heat the volume of the personal fluid within this reservoir before dispensing the heated personal fluid, and after each holding reservoir amount of personal fluid is dispensed, the cycle of urging the fluid into the holding reservoir, allowing the personal fluid to become stagnant, and then heating the personal fluid, the prolonged period of time must be repeated, or if the holding reservoir is of sufficient size to hold enough personal fluid for several or more dispenses of personal fluid, the user must endure even a longer prolonged period of time for the initial or first dispense of heated personal fluid.

Still in other present art, the personal fluid has to be of a special type or of a certain viscosity in order for the special heating apparatus to effectively heat the personal fluid, and the user must endure the cost and the availability of obtaining this special type of personal fluid to be used within that special apparatus.

Still in other present art, the personal fluid is contained within a special cartridge, or the personal fluid has to be poured or moved into this special cartridge and in some present art, the cartridge contains all or a portion of the heating means, and the user must not only endure the cost and availability of this special cartridge, the user must endure the prolonged time to heat the personal fluid within this special cartridge.

In all present art, in which the personal fluid heating dispenser suffers from one or more of the above disadvantages, present art suffers another disadvantage in that present art is not replaceable into a plurality of personal fluid bottles or containers and therefore cannot freely move from common, inexpensive, mass produced, off-the-shelf, personal fluid plastic bottle or container to another after the personal fluid of that plastic bottle or container has been fully dispensed, or empty, and none of the present art can utilize the existent plastic bottle or container, off-the shelf, without assuming the risk of heating the plastic bottle or container and potentially having chemicals leach from the plastic bottle or container into the personal fluid.

In all present art, suffers another disadvantage in that all present art cannot heat the personal fluid immediately, within tenths of a second, initially and continuously, unless an entire volume of the personal fluid is heated, or a special apparatus for heating is used, or a special cartridge is used, and again, the user must endure either an initial, or repeated, prolonged period of time to heat the personal fluid.

In all present art, does not detect or sense the personal fluid velocity, or flow rate, within the dispenser, because present art, the personal fluid is stagnant, not moving, because present art heats the personal fluid while the personal fluid is stagnant, and thereby requiring time to heat the volume or a portion thereof, of personal fluid.

In present art, may use sensors or sensing means to detect touch of the user, to detect temperature of the personal fluid, to detect the presence or absence of personal fluid, but present are does not sense or detect the malfunction of the heating means, for it is assumed by present art the user will detect the dispenser is not heating by application of non-heated personal fluid onto the hand or body and thereby the user assumes the heating means has malfunctioned.

In present art, does not take into account the heating dispenser will most likely be kept within the bathroom or bathroom area where water is present, and present art does not sense or detect if power, the AC wall outlet or other electrical source, to the heating dispenser, has come in contact with water causing a potential for an electric shock.

In present art, does not take into account the variety of personal fluids, a lotion or gel or liquid, and due to the different or varying viscosities of these personal fluids, without continuous user temperature adjustment, have a means for sensing the different viscosities, and automatically maintain a set user temperature adjustment from one viscous personal fluid to another.

In present art, does not have a means to determine when the actual volume of personal fluid to be heated has diminished, as in the case when the personal fluid is near empty, and a smaller than normal amount of personal fluid is within present art's heating means.

In present art, does not sense or detect the personal fluid at the point of dispensing the personal fluid onto the user, hence, present art does not sense or detect for the possibility of a clog or dam to the personal fluid, for again, present art assumes that if no personal fluid is being dispensed it is up to the user to ascertain a clog or dam of the personal fluid within the dispenser has occurred.

OBJECTIVES

One object of the present invention is to provide a low cost inexpensive replaceable pump personal fluid dispenser that is able to insert into and attach to existent inexpensive mass produced off-the-shelf plastic personal fluid bottles or containers of varying sizes and depths.

Another object of the present invention is to provide a replaceable pump personal fluid dispenser with a heating means which heats the personal fluid instantaneously while the personal fluid is flowing or in motion without the prolonged stagnant initial or on going period of time for personal fluid to be heated.

Another object of the present invention is to provide a heating means which heats the personal fluid in a manner that does not expose potential chemicals from leaching out of the personal fluid plastic bottle or container into the personal fluid by prolonged heating of the plastic bottle or container.

Another object of the present invention is to sense if no personal fluid is at the dispensing point of the dispenser, indicating a clog or dam, and informing the user no personal fluid can be dispensed.

Another object of the present invention is to sense or measure the velocity or flow rate of the personal fluid as it flows through a defined diameter tube within, integral of, the dispenser.

Another object of the present invention is by using this personal fluid velocity, or flow rate, determine the amount of heating required into the personal fluid, because of varying viscosities of personal fluid, to yield a user set temperature into the personal fluid.

Another object of the present invention is to sense if the heating means is no longer operating, thereby not heating the personal fluid, and inform the user it is time to replace the present invention.

Another object of the present invention is to sense if the power source has come in contact with water, potentially causing an electrical shock, and have the power source immediately disconnect from the AC wall outlet to provide safety to the user and further, to inform the user the power source is not in operation.

Another object of the present invention is to detect when the dispenser has been removed from the personal fluid bottle or container to ensure the heating means remains inoperable until re-inserted into and secured onto the personal fluid bottle or container, this thus providing enhanced user safety.

DESCRIPTION OF THE FIGURES

FIG. 1 is an exploded perspective view of a Replaceable Manual Pump Heating Personal Fluid Dispenser with the heating means shown in various locations such as about the intake tube (4*b*), or about the closure tube (2*d*), or about the pump housing tube (3*a*).

Figure 2C:
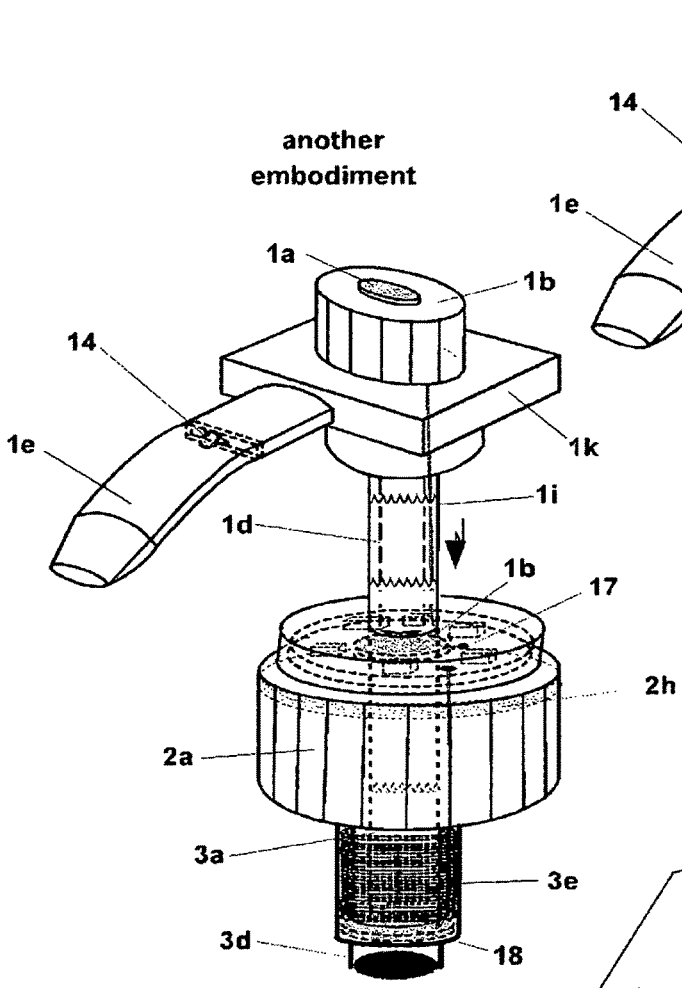

Group 1 of FIG. 1 is the Actuator Assembly.

Group 2 of FIG. 1 is the Closure Assembly.

Group 3 of FIG. 1 is the Pump Housing Assembly.

Group 4 of FIG. 1 is the Intake Tube Assembly.

Group 5 of FIG. 1 is the Power Source and Control Electronics Assembly.

FIG. 1A is an exploded perspective view of the Actuator Assembly (Group 1 of FIG. 1) of the Replaceable Manual Pump Heating Personal Fluid Dispenser with the heating means about the Actuator Piston Tube (1*d*).

FIG. 1B is an exploded perspective view of the Actuator Assembly (Group 1 of FIG. 1) of the Replaceable Manual Pump Heating Personal Fluid Dispenser with the heating means about the Actuator Dispensing Tube (1*e*).

FIG. 1C are cross sectional views of the heating means about a tube of the Replaceable Manual Pump Heating Personal Fluid Dispenser wherein the heating means would be a thermal conductor (7) or inductive coil (7), about a metal tube (6), an electro-hydrodynamic coil (7) about a nonmetallic tube (9), an inner thermal conducting solid rod (10), or thermal radiator within a metallic or nonmetallic tube (11) or capacitive plates opposed to a tube (12).

FIG. 1D are exploded perspective views of different types of Closure Assembly's in which is shown a clamp or snap fit closure (2*b*) and a plug fit closure (2*c*) which could replace or be encompassed within the screw closure (2*a*) in FIG. 1 of the Replaceable Manual Pump Heating Personal Fluid Dispenser, depending on the type of personal fluid bottle or container attachment (3*c*).

Figure 2B:
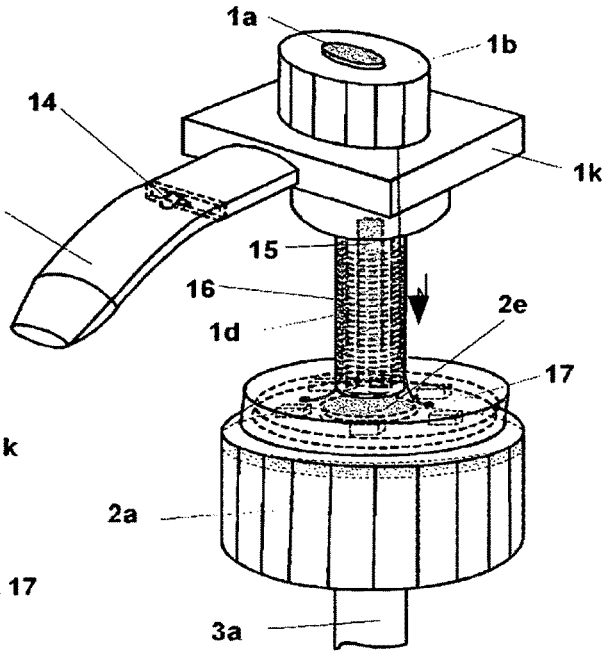
Figure 2A:
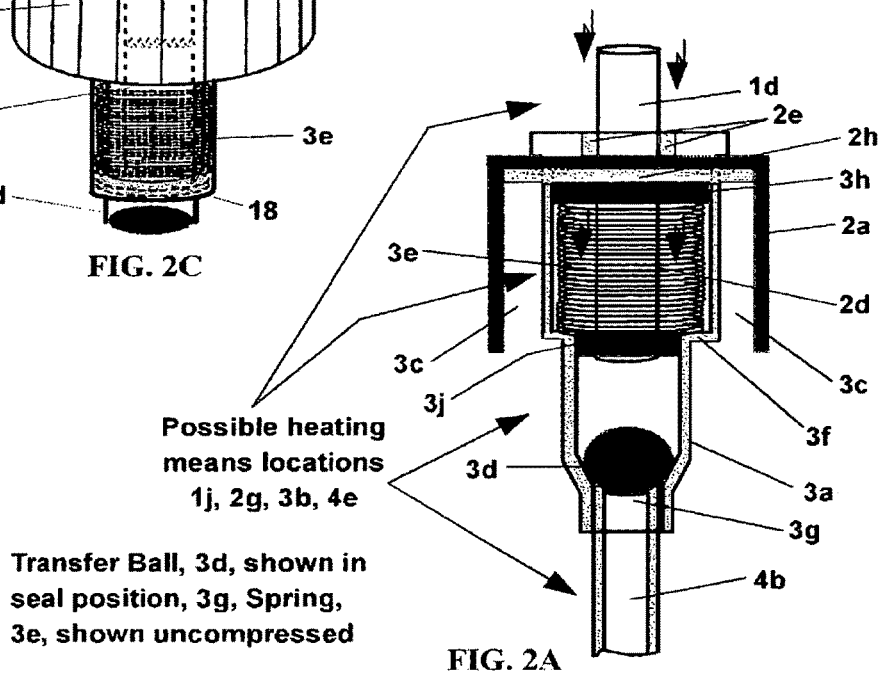

FIG. 2A is a semi-cross-sectional view of the Pump Housing Assembly (FIG. 1, Group 3) including portions of the Closure Assembly (FIG. 1, Group 2) universal screw closure (2*a*), closure tube (2*d*), closure attachment sensor (2*h*), including portions of the Push Actuator Assembly (FIG. 1. Group 1) push actuator piston tube (1*d*), and the Intake Tube Assembly (FIG. 1, Group 4), intake tube (4*b*), the transfer tube (3*a*), the biasing piston (3*h*), fluid piston (3*j*), closure tube stop (3*f*), personal fluid closure attachment position (3*c*), transfer ball (3*d*), biasing device or spring (3*e*), and possible locations of the heating means (1*j*, 2*g*, 3*b*, 4*e*).

FIG. 2B is an exploded perspective view of the Actuator Assembly (FIG. 1, Group 1) and Closure Assembly (FIG. 1, Group 2) of the Replaceable Manual Pump Heating Personal Fluid Dispenser in which the power source has been integrated about and within the actuator piston (1*d*) and closure assembly (FIG. 1, Group 2) in which the power source is a straight magnet (15), surrounding coil (16), and associated electronics (17), whereby in this embodiment a valve (14) is used to delay the personal fluid from dispensing so as to allow the movement of the actuator to create power and thereby heat the personal fluid by a heating means as the fluid flows through a tube or tubes integral to the dispenser.

FIG. 2C is an exploded perspective view of the Actuator Assembly (FIG. 1, Group 1) and Closure Assembly (FIG. 1. Group 2) of the Replaceable Manual Pump Heating Personal Fluid Dispenser in which the power source has been integrated about and within the actuator piston (1*d*) and closure assembly (FIG. 1, Group 2) in which the power source is a semi-solid compression rod (1*i*) impacting onto a piezoelectric-element (18) and associated electronics (17), whereby in this embodiment a valve (14) is used to delay the personal fluid from dispensing so as to allow the movement of the actuator and thereby force against or impact onto the piezoelectric-element thereby creating power and thereby heat the personal fluid by a heating means as the fluid flows through a tube or tubes integral to the dispenser.

Figure 3A:
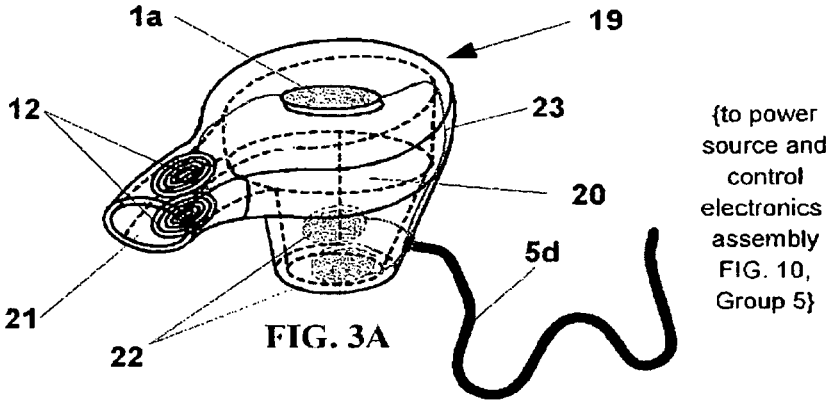

FIG. 3A is an exploded perspective view of another embodiment of the replaceable pump personal fluid dispenser in that a Heating Bootie (19) including a heating means (12) on opposing sides of the Heating Bootie dispensing hollow (21) and multi-functional sensors (22) would use the existing actuator assembly of the off-the-shelf personal fluid plastic bottle or container, in that the Heating Bootie (19) would be pulled over and about the existing actuator assembly to be within the Heating Bootie Hollow Cavity (20).

Figure 3B:
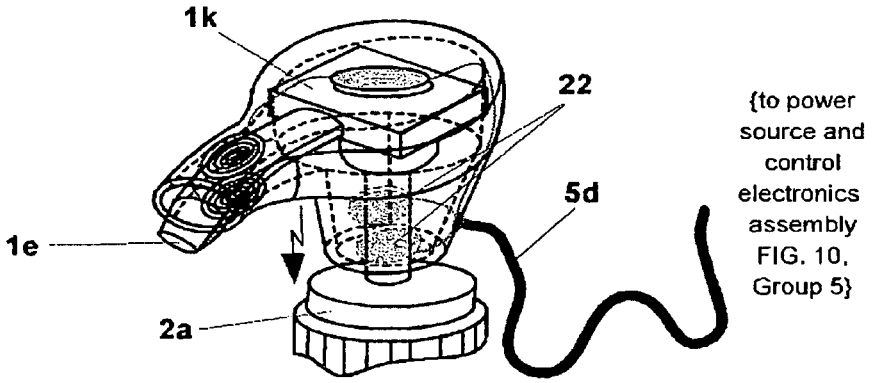

FIG. 3B is an exploded perspective view of the Heating Bootie (19) of FIG. 3A pulled over and about an existing actuator assembly of an off-the-shelf personal fluid bottle or container.

Figure 4:
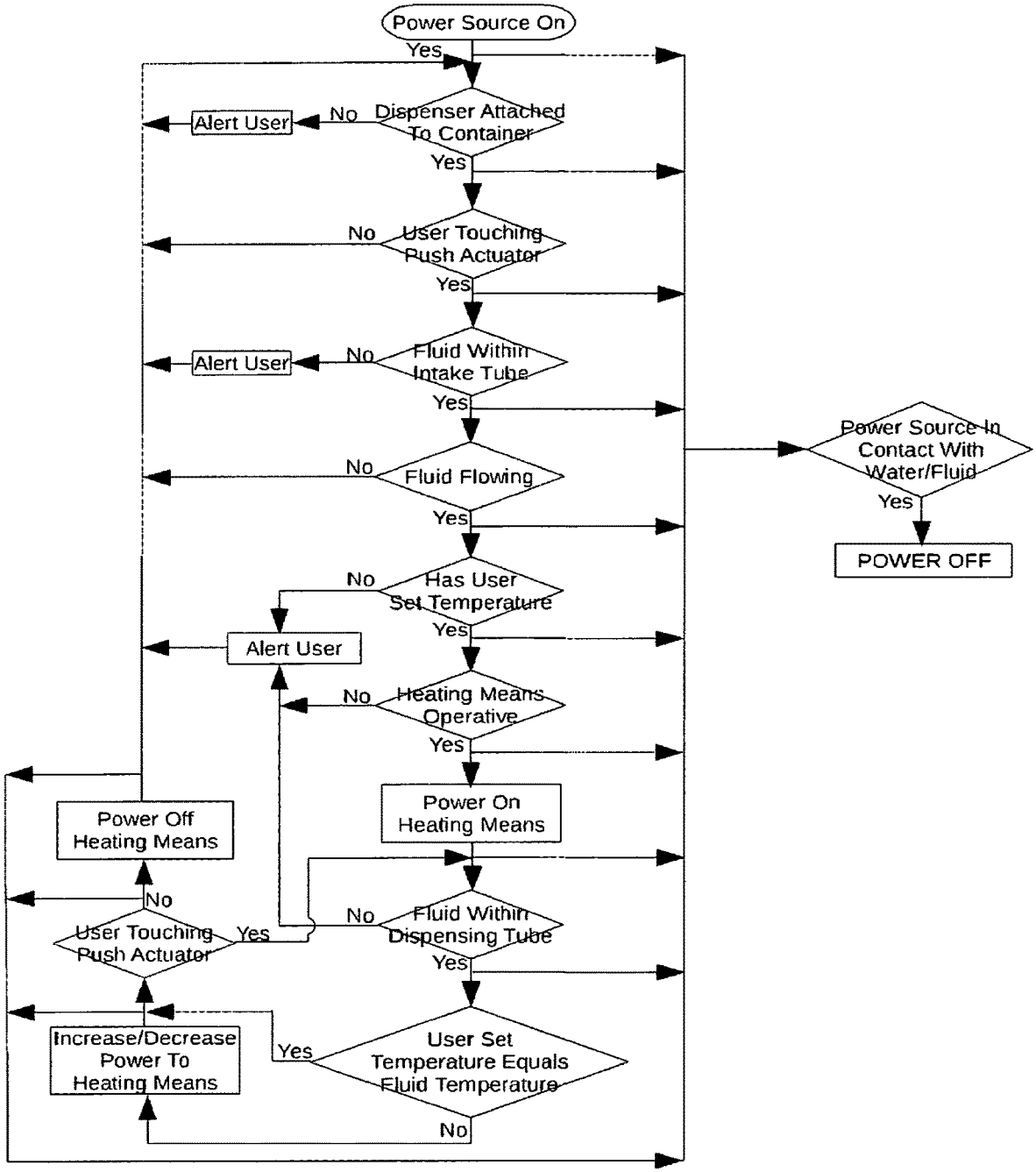

FIG. 4 is a flow chart of the Power Source And Control Electronics (FIG. 1, Group 5) operation which depicts the steps to control the heating means in which will heat the personal fluid upon user demand in conjunction with ensuring user safety and alert the user in the event the heating means is inoperable, or if the temperature has not been set by the user or if there is no personal fluid.

SUMMARY OF THE INVENTION

A replaceable manual pump heating personal fluid dispenser to dispense heated personal fluid, which can insert into a plurality of inexpensive mass produced off-the-shelf personal fluid plastic bottles or containers, comprising; a hand-operated push actuator to urge the personal fluid from the bottle or container holding the personal fluid through the tube(s) integral of the dispenser with user downward pressure of the push actuator; a heating means to heat the personal fluid as the personal fluid is in motion flowing through a tube or tubes integral of the dispenser; a perforated intake tube to allow the user to snap or break off portions of the intake tube to allow for varying depths of the personal fluid bottle or container; an adjustment control device to allow the user to control the heating of the heating means and thereby control the temperature of the personal fluid; a sensor to indicate touch onto the push actuator to determine when the heating of the personal fluid should commence; a sensor to determine velocity or flow rate of the personal fluid; a sensor to indicate the presence of personal fluid in a multitude of locations; a sensor to indicate if the dispenser has been removed from the personal fluid bottle or container; a sensor to indicate the temperature of the personal fluid; a sensor to indicate if the personal fluid is not being dispensed from the dispensing tube; a sensor to indicate inoperable heating means; and a sensor to indicate if the power source has come in contact with water or personal fluid.

DETAILED DESCRIPTION

Definitions

Personal Fluid: "Personal Fluid" means a lotion or gel or liquid or cream for use on one's person or body, such as hand lotion or body lotion or makeup removing gel or liquid or hair cream or gel.

Manual: "Manual" means, hand-operated, or put into operation by using one's hand or hands or done or operated by one's hand or hands.

Replaceable: "Replaceable" means the present invention can be inserted into and attached to a plurality of inexpensive off-the-self, in most cases, plastic, personal fluid bottles or containers (such as Suave Hand Lotion) as one would purchase from a retail store, such as Walmart.

Heating or Heat: "Heating" or "Heat" means to cause or produce an increase in temperature of the personal fluid, such that if the personal fluid temperature is 70 degrees Fahrenheit, heating or heat would cause the personal fluid's temperature to increase, as an example, to 80 degrees Fahrenheit.

Tube: "Tube" means a hollow tube, not closed on either end, an inlet (an entrance orifice) and an outlet (an exit orifice), such that this tube has an inner and outer diameter and can be made of various material(s), an example would be a glass tube or ceramic tube or metal tube.

About a/the Tube or About: "About a/the Tube or About" means around the tube or assembly or encircles the tube or assembly, as example, wrapped around the tube, or the wire is wrapped around the tube creating a coil of wire, with the tube and the personal fluid within the tube being the core of the coil.

Opposing Sides of a/the Tube or Opposing Sides: "Opposing Sides of a/the Tube or Opposing Sides" means to be 180 degrees opposite of each other, or to be directly across from one another yet not touching or coming in physical contact with each other, to be parallel to each other with no physical contact to each other, parallel plates spaced apart a distance across from each other and never coming into physical contact with each other, whereby an example would be the parallel plates of a capacitive conductor or capacitor in which the parallel plates of the capacitive conductor or capacitor never come in physical contact with each other and the tube and the personal fluid is the dielectric of the capacitive conductor or capacitor.

Flows Through a Tube" "Flows Through a Tube" means as the personal fluid moves or is not stagnant or static, but is in motion within a hollow tube, or is being urged into motion within a hollow tube, as would be the case of pumping lotion from a hand lotion bottle onto the hand, the lotion, in part, is moving through the hollow dispensing tube onto the hand.

Heating Means: "Heating Means" is the means to create or produce and induce heating or heat into the personal fluid. Cross sectional view(s) of some, not all, of such Heating Means are shown in FIG. 1C, 6—a metal tube in which the thermal or electrical wire is about, 7—the thermal or electrical wire, 8—an outer sheath to protect and prevent thermal or electrical wire from physical contact with the personal fluid, 9—a non-metallic tube, to protect and prevent electrical wire or capacitor conductor plates from physical contact with the personal fluid, 10—internal tube metal rod used for heating, 11—internal metal radiator used for heating, 12—capacitive conductor opposing parallel metal plates, 13—a non-metallic tube representative of any of the tubes used in the present invention. Though not limited to just these means, examples of heating means are, 1) conduction heating; using a thermal inducing wire or conductor about a metal tube, or having the metal tube as the conductor itself, whereas electrical current is passed into the conductor causing it to heat, which then transfers this heat into the personal fluid, 2) another means of conduction heating; using a thermal inducing radiator, whereas electrical current is passed into the radiator causing the radiator to heat which then transfers this heat to the personal fluid, 3) induction heating; an inductive coil about a metal tube and the metal tube heats by induction which then transfers this heat to the personal fluid, 4) another means of induction heating; an inductive coil about a non-metallic tube whereas within this tube is a solid or semi-solid metal rod which heats by induction and the heated rod then transfers this heat to the personal fluid, 5) another means of induction heating; an inductive coil about a non-metallic tube whereas within this tube is a solid or semi-solid metal radiator which heats by induction and the heated radiator then transfers this heat to the personal fluid, 6) RF heating; an RF semiconductor which produces microwave energy, on opposing sides of a non-metallic tube, inducing high frequency excitation of the molecules of the personal fluid itself, similar heating as in a microwave oven, and thereby heating the personal fluid directly, 7) electro-hydrodynamic heating; an electro-hydrodynamic coil wrapped about a non-metallic tube such that the wire wrappings or coil are wrapped sinusoidal opposed creating a forward and reversed magnetic field forcing molecules of the personal fluid in forward and reverse directions, causing personal fluid molecules to smash into one another yielding heat, and thereby heating the personal fluid directly, 8) dielectric heating; using capacitive plates, parallel thin metal plates, on opposing sides of a non-metallic tube and inducing an electrical frequency between these plates thereby causing the molecules of the personal fluid to rotate at a very high rate which in turn causes the molecules of the personal fluid to heat thereby heating the personal fluid directly, 9) semiconductor heating; heating by means of which a current is passed through a semiconductor causing it to heat which is in thermal contact with a metal tube containing the personal fluid thereby transferring this heat into the personal fluid, 10) laser heating; using a semiconductor laser such that the laser light shines through a clear non-metallic tube and into the personal fluid thereby exciting the molecules of the personal fluid and heating the personal fluid directly, 11) piezoelectric heating; using a piezoelectric element such that a harmonic frequency of the piezoelectric element is induced into the piezoelectric element causing it to self heat, this heat is in thermal contact with a metal tube containing the personal fluid which in turn heats the personal fluid, 12) infrared heating; using an infrared emitter through a clear non-metallic tube thereby radiating heat directly into the personal fluid, 13) combination heating; in which partial, some or all of the aforementioned heating means is/are used.

Sensor: "Sensor" means a device that responds to a physical stimulus (such as user touch, fluid heat, fluid presence, fluid motion, fluid flow rate, fluid or tube pressure) and transmits a resulting electrical or electronic signal.

Actuator Assembly: "Actuator Assembly" means, as shown in FIG. 1, Group 1, FIG. 1A, FIG. 1B, FIG. 2A, FIG. 2B; 1*a*—a touch sensor, 1*b*—one possible location for the user temperature adjustment control for the personal fluid, 1*c*—fluid presence sensor, 1*d*—push actuator piston tube, 1*e*—push actuator dispensing tube, 1*f*—fluid temperature sensor, 1*g*—one possible location of the female power connector to connect to the power source assembly, 1*h*—one possible location of the heating means on or about or within the push actuator dispensing tube, 1*i*—in another embodiment, a semi-solid compression rod to be used to strike a piezoelectric-element (18) when the user pushes the actuator (1*k*) downward causing current to flow from the piezoelectric-element (18) and hence providing power, in embodiments FIG. 2B, FIG. 2C, valve (14) is used to delay personal fluid from dispensing allowing power to be generated for the heating means, 1*j*—another possible location for the heating means on or about or within the push actuator piston tube (1*d*), 1*k*—the push actuator.

Closure Assembly: "Closure Assembly" means, as shown in FIG. 1, Group 2, FIG. 1D, 2*a*—screw closure, 2*b*—clamp or snap fit closure, 2*c*-plug fit closure, 2*d*—closure tube, 2*e*—one possible location of the velocity or flow rate sensor, 2*f*—a possible location of the female power connector to connect to the power source and control electronics assembly (Group 5), 2*g*—another possible location of the heating means on or about or within the closure tube, 2*h*—closure attachment sensor.

Pump Housing Assembly: "Pump Housing Assembly" means, as shown in FIG. 1, Group 3, 3*a*—pump housing or tapered transfer tube, 3*b*—another possible location of the heating means on or about or within the pump housing tube or transfer tube, 3*c*—personal fluid bottle or container closure attachment for the universal screw (2*a*) or plug fit (2*b*) or snap fit (2*c*) closure, attaches thereon, 3*d*—transfer ball at rest sealing the tail end or tapered end of the transfer tube (3*a*), 3*e*—pump biasing device, such as a spring, for reciprocal operation of the actuator assembly (Group 1) and in part, the closure assembly (Group 2), 3*f*—(FIG. 2A) transfer tube stop points for basing piston, 3*g*—(FIG. 2A) transfer ball seated at tapered end of transfer tube, 3*h*-(FIG. 2A) biasing piston, 3*j*-(FIG. 2A) fluid piston.

Intake Tube Assembly: "Intake Tube Assembly" means, as shown in FIG. 1, Group 4, 4*a*—personal fluid bottle or container, 4*b*—tapered neck intake or dip tube, 4*c*—fluid presence sensor, 4*e*—another possible location of the heating means on or about or within the intake tube (4*b*), 4*f*—personal fluid, 4*g*—one example of a connection wire from the female power connector to the heating means, 4*h*—perforations on the intake tube to allow the intake tube (4*b*) to be snapped apart at varying lengths allowing for different personal fluid bottle (4*a*) depths.

Power Source and Control Electronics Assembly: "Power Source Assembly" means, as shown in FIG. 1, Group 5, 5*a*—power source transformer, 5*b*—power source malfunction sensor, 5*c*—another possible location of the user temperature adjustment control for the personal fluid, 5*d*—electrical wire connection from the power source transformer (5*a*) and control (5*c*) to the male power connector (5*e*), 5*e*—male power connector attached to the electrical wire connection (5*d*), 5*f*—one possible location of the ground fault sensor to determine if water or personal fluid has come in contact with the power source assembly AC electrical connection (5*g*), causing the potential for electric shock, 5*g*—male AC wall outlet connector, 5*h*—heating means and sensor(s) input control electronics. In another embodiment, not shown, the Power Source could be a battery or rechargeable battery and could be within, about, any of the Assembly's aforementioned.

Sensors:

In the present invention, one of the main advantages over all other present art is the ability to heat the personal fluid instantaneously while the personal fluid is in motion or flowing within a tube or tubes, within tenths of a second, using the inexpensive off-the-shelf personal fluid bottle or container, as the storage tank for the personal fluid. The average time for a user to depress the push actuator, 1*k*, downward, to its most negative position, or stop point, 3*f*, varies between, 0.100 to 1.00 seconds, based on a piston tube, 1*d*, of a constant length, normally called stroke distance or stroke length, and how firm or with what force, the user has applied downward pressure to the push actuator, 1*k*. During this instantaneous time, the present invention must heat the personal fluid while the personal fluid flows through one or more tubes of the present invention. In order for the pump housing assembly, Group 3, of the present invention to urge the personal fluid into and through tubes integral to the present invention, the present invention must be securely attached to the off-the-shelf personal fluid bottle or container, at the bottle's attachment, 3*c*. Attachment sensor, 2*h*, verifies the universal screw closure, 2*a*, is secure onto the bottle's attachment, 3*c*, and if not, via the power and control electronics assembly, Group 5, the heating means is disabled, turned off. Also, there must be personal fluid to heat, thereby, sensor 1*c*, and 4*c*, indicate personal fluid presence. Further, the function between how fast or velocity, flow rate, of the personal fluid, caused by user downward pressure onto the push actuator, 1*k*, fluid presence, and the user set temperature, must be known in order to efficiently heat the personal fluid to the user's desired temperature, as set by the user temperature control, 1*b* or 5*c*. Push actuator touch sensor, 1*a*, flow rate sensor, 2*e*, temperature sensor, 1*f*, and fluid presence sensor, 1*c*, 4*c*, communicate to the power source and control electronics assembly, Group 5, for the control electronics, 5*h*, to calculate and electrically drive, provide current and voltage, to one or more of the heating means, 1*h*, 1*j*, 2*g*, 3*b*, 4*e*, providing, heating means inoperable sensor, 5*b*, indicates the heating means is operational, and ground fault sensor, 5*f*, indicates the power source has not come in contact with water or personal fluid, to yield the user's desired temperature of the personal fluid. (Depicted in FIG. 4)

Physical:

FIG. 1 illustrates the preferred embodiment of the present invention, and may include a first sensor, 1*a*, positioned atop the push actuator, 1*k*, a dispensing tube, 1*e*, horizontally integral with push actuator, 1*k*, which may contain a second and third sensor internal to the dispensing tube (1*e*), 1*f*, and 1*c*, respectively, which may contain heating means, (FIG. 1B), 1*h*, on or about or within the dispensing tube, 1*e*, a piston tube, 1*d*, vertically integral with push actuator, 1*k*, which may contain heating means, 1*j*, (FIG. 1A), on or about or within piston tube, 1*d*; a closure tube, 2*d*, serially integral to piston tube, 1*d*, which may contain heating means, 2*g*, on or about or within closure tube, 2*d*, which may contain a fourth sensor, 2*e*; a universal threaded, snap, plug hollowed cap, or closure, 2*a*, with the top most portion of closure, 2*a*, integrally about closure tube, 2*d*, which may contain a fifth sensor, 2*h*, within closure, 2*a*, with closure, 2*a*, having the capability to turn onto or snap onto or plug into container closure attachment, 3*c*; a transfer tube, 3*a*, vertically integral with closure, 2*a*, serially integral with closure tube, 2*d*, which may contain heating means, 3*b*, on or about or within the transfer tube, 3*a*, with biasing piston, 3*h*, to support at one upward end the biasing device, 3*e*, such as a spring, (FIG. 2A), such that biasing piston, 3*h*, upon user downward pressure, compresses biasing device, 3*e*, within transfer tube, 3*a*, with the downward end of the biasing device supported within the transfer tube, 3*a*, at points, 3*f*; fluid piston, 3*j*, vertically integral and reciprocal with closure tube, 2*d*, within transfer tube 3*a*, such that upon same user downward pressure, urges fluid into closure tube, 2*d*; sealing ball or transfer ball, 3*d*, in contact with the tapered end of transfer tube, 3*a*, such that upon same user downward pressure, prevents personal fluid flow downward and into intake tube, 4*b*; intake tube, 4*b*, vertically and serially integral with transfer tube 3*a*, intake tube, 4*b*, having perforations, 4*h*, about its lower lateral end or approximately 50% of the intake tube, 4*b*, to allow for bottle depth adjustment by snapping off those portions of intake tube, 4*b*, dependent on bottle depth, with the upper portion of the intake tube, 4*b*, may contain heating means, 4*e*, on or about or within intake tube, 4*b*, which may contain a sixth sensor, 4*c*.

The flow of fluid through the present invention is, from the personal fluid, 4*f*, in the personal fluid container, 4*a*, into and through intake tube, 4*b*, into and through the transfer tube, 3*a*, into and through the closure tube, 2*d*, into and through the piston tube, 1*d*, into and through the push actuator, 1*k*, and into and through the actuator dispensing tube, 1*e*, thereby heated personal fluid out and onto the user's hand or body.

FIG. 1, Group 5, indicates the power source and control electronics, in communication with the sensors, to control the heating means in one or more of the various locations about the present invention, with possible connections to the present invention at the actuator assembly, FIG. 1, Group 1, 1*g*, or closure assembly, FIG. 1, Group 2, 2*f*.

User temperature control of the personal fluid is obtained by temperature control adjustment about one such location on the actuator assembly, FIG. 1. Group 1, 1*b*, with another possible location, the power source and control electronics assembly, FIG. 1. Group 5, 5*c*.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

Operation:

(Of FIG. 1, 1A, 1B, and referenced internally by FIG. 2A, electronics control, FIG. 4) There are 2 phases in which the present invention operates. Phase 1, or Initial Phase or Priming Phase; The present invention has been initially inserted into a personal fluid bottle or container and no personal fluid is within any tube integral to the present invention. Phase 2 or Operating Phase; Personal fluid exists within a tube or tubes integral of the present invention.

Phase 1, Priming Phase: The push actuator, 1*k*, begins at its, at rest, most vertical upward position, biasing device or spring, 3*e*, is uncompressed, fully extended, and transfer ball, 3*d*, is at its most negative, downward position, 3*g*, within the tapered portion of the transfer tube, 3*a*, sealing the transfer tube, 3*a*, as the push actuator, 1*k*, has no external force or downward pressure exerted onto it by the user. Upon the user pressing down onto the push actuator, 1*k*, the user comes in contact with touch sensor, 1*a*, which communicates to the control electronics, 5*h*, via cable, 5*d*, the user is in contact with the push actuator, 1*k*, and heated personal fluid is desired. Closure attachment sensor, 2*h*, fluid presence sensors, 1*c*, and 4*c*, and flow rate sensor, 2*e*, communicate to the control electronics, 5*h*, via cable, 5*d*, the present invention is attached to the personal fluid bottle or container, 4*a*, and there is no personal fluid present or personal fluid movement, within any tube(s) of the present invention. This dictates to the control electronics, 5*h*, not to drive, not to provide voltage and current to, hence turn off, the heating means in one or more possible locations, 1*h*, 1*j*, 2*g*, 3*b*, 4*e*. As the user continues to press push actuator, 1*k*, downward, the actuator piston tube, 1*d*, biasing piston, 3*h*, internal to the closure tube, 2*d*, moves downward to compress spring, 3*e*, until biasing piston, 3*h*, internal to closure tube, 2*d*, reaches its furthest negative or downward position, its stop points, 3*f*. Upon user release of push actuator, 1*k*, spring, 3*e*, exerts upward, positive, force onto the biasing piston, 3*h*, internal to closure tube, 2*d*, and piston tube, 1*d*, raises the push actuator, 1*k*, upward towards its at rest position. As push actuator, 1*k*, moves upwards towards its at rest position, upward air pressure is exerted by upward movement of fluid piston, 3*j*, internal to the transfer tube, 3*a*, which draws the transfer ball, 3*d*, from its seal position, 3*g*, upward and away from the tapered tail of the transfer tube, 3*a*, unsealing the transfer tube, 3*a*, and draws by pressure, the personal fluid, 4*f*, within the bottle or container, 4*a*, into the intake tube, 4*b*, passing fluid presence sensor, 4*c*, and continues into the transfer tube, 3*a*. Upon the push actuator, 1*k*, reaching its, at rest position, spring, 3*e*, is uncompressed and fully extended, biasing piston, 3*h*, and fluid piston, 3*j*, internal to closure tube, 2*d*, and piston tube, 1*d*, are at their most positive, upward positions. Transfer tube, 3*a*, is now filled with personal fluid, 4*f*, from personal fluid bottle, 4*a*, and fluid presence sensor, 4*c*, communicates to the control electronics, 5*h*, via cable, 5*d*, personal fluid is within intake tube, 4*b*.

Phase 2, Operating Phase: As explained in Phase 1, upon the user pressing down onto the push actuator, 1*k*, the user comes in contact with touch sensor, 1*a*, which communicates to the control electronics, 5*h*, via cable, 5*d*, heated personal fluid is desired. Continued downward movement of the push actuator, 1*k*, moves the biasing piston, 3*h*, internal to the closure tube, 2*d*, downward, compressing spring, 3*e*, moving fluid piston, 3*j*, downward, using the personal fluid within the transfer tube, 3*a*, to exert downward force upon the transfer ball, 3*d*, moving the transfer ball, 3*d*, into its seal position, 3*g*, preventing personal fluid from flowing back into the intake tube, 4*b*. The personal fluid within transfer tube, 3*a*, caused by downward movement of fluid piston, 3*j*, is urged up and into the closure tube, 2*d*, passing through the flow rate sensor, 2*e*, which communicates to the control electronics, 5*h*, via cable, 5*d*, to supply power, provide voltage and current, to the heating means in one or more possible locations, 1*h*, 1*j*, 2*g*, 3*b*, 4*e*, which instantaneously heats the personal fluid. Upon this same downward movement of push actuator, 1*k*, personal fluid is urged from the closure tube, 2*d*, into the piston tube, 1*d*, into the push actuator, 1*k*, and into the dispensing tube, 1*e*, passing fluid temperature sensor, 1*f*, which communicates to the control electronics, 5*h*, via cable, 5*d*, verifying personal fluid temperature to that set from the user temperature control, 1*b* or 5*c*, passing fluid presence sensor, 1*c*, which communicates to the control electronics, 5*h*, via cable, 5*d*, personal fluid is at the dispensing point of dispensing tube, 1*e*, and by this same continued downward movement of push actuator, 1*k*, heated personal fluid is forced out and onto the user's hand or body. Upon user release of the actuator, 1*k*, spring, 3*e*, exerts upward force, onto the biasing piston, 3*h*, integral to the closure tube, 2*d*, and piston tube, 1*d*, raises the push actuator, 1*k*, towards its at rest position. Upward air pressure, caused by fluid piston, 3*j*, is exerted within the transfer tube, 3*a*, draws the transfer ball, 3*d*, upward and away from the tapered end of the transfer tube, 3*a*, seal position, 3*g*, unsealing the transfer tube 3*a*, and draws by pressure, the personal fluid, 4*f*, within the bottle or container, 4*a*, into the intake tube, 4*b*, which fluid presence sensor, 4*c*, confirms to the control electronics, 5*h*, fluid is present within intake tube, 4*b*, and personal fluid continues into the transfer tube, 3*a*, replacing the personal fluid which has been dispensed previously from the transfer tube, 3*a*. As the push actuator, 1*k*, reaches it most positive upward at rest position, flow rate sensor, 2*e*, communicates to the control electronics, 5*h*, there is no longer movement or flow, of the personal fluid, in the closure tube, 2*d*, and the control electronics, 5*h*, via cable, 5*d*, terminates power, ceases voltage and current, to the heating means, in one or more possible locations, 1*h*, 1*j*, 2*g*, 3*b*, 4*e*, in effect, turns off heating of the personal fluid.

Methods of Use:

Methods of using the present invention as described herein, may include the following steps, as example. A user purchases an off-the-shelf plastic hand lotion (personal fluid) bottle of round or oval shape from a retail store, such as Walmart or Target. The user unscrews or unsnaps the closure, bottle cap, atop the lotion bottle, and removes the existing actuator, closure, and pump housing assembly, along with the intake tube attached to its above assembly (intake tube assembly), previously within the lotion bottle. The user sets aside or discards this actuator, pump, closure, and intake tube assembly. With the lotion bottle upright, the user stands the present invention upright, along side the lotion bottle to gauge the depth of the lotion bottle so as to determine the present invention's intake tube, 4*b*, depth, needed to reach the bottom of the lotion bottle. The user snaps off the appropriated partitioned, perforated, 4*h*, amount of intake tube, 4*b*, to ensure proper intake tube, 4*b*, bottle depth or length. The user then inserts the present invention, intake tube assembly, Group 4, first, along with the pump housing assembly, Group 3, closure assembly, Group 2, and actuator assembly, Group 1, into the lotion bottle. The user then screws or snaps or plugs the universal closure, 2*a*, of the present invention onto or into the lotion bottle attachment, 3*c*, of the lotion bottle, 4*a*. The user plugs the power source and control electronics assembly, Group 5, the transformer, 5*a*, into an AC wall outlet. The user plugs the male power connector, 5*e*, into the female power connector, 1*g* or 2*f*. The user adjusts the temperature control, 1*b* or 5*c*, to the user desired temperature using the temperature control adjustment, 1*b* or 5*c*. With one hand, the user depresses the present invention's push actuator, 1*k*, downward, contacting the touch sensor, 1*a*, with sufficient force to cause the push actuator, 1*k*, to move in a downward direction until the biasing piston, 3*h*, reaches its stop points, 3*f*, within the transfer tube, 3*a*, while the other hand is placed below the present invention's dispensing tube, 1*e*. Out flows heated lotion and the user now enjoys his/her heated lotion without the necessity of waiting seconds or minutes for the lotion to heat, before the user can enjoy the heated lotion on his/her hands or body.

With the present invention, Replaceable Manual Pump Heating Personal Fluid Dispenser, the user has on demand heated lotion without the need for some special apparatus to hold the lotion, or have the lotion bottle of a specific size, or a special cartridge, or to refill something, or time to wait for the initial lotion to heat, but is using the same round or oval plastic bottle the user has purchased at any retail, grocery, or pharmacy store, inexpensive, cost effective, just insert the present invention into the plastic lotion bottle the user has purchased, and enjoy heated lotion.

The invention claimed is:

1. A replaceable hand-operated pump heating dispenser for the heating of personal fluid, comprising:

a replaceable dispenser for inserting into a plurality of mass produced off-the-shelf personal fluid bottles or containers, comprising;

a dispensing tube, a hand-operated push actuator with an internal tube, a piston tube, a closure tube, a transfer tube, a transfer ball, a perforated intake tube, wherein;

the perforated intake tube, when said replaceable dispenser inserts into the personal fluid bottle or container, engages, becomes in fluid communication with, the personal fluid within the personal fluid bottle or container;

a universal closure means to attach the said replaceable dispenser onto the mass produced off-the-shelf personal fluid bottle or container, wherein;

when said dispenser inserts into the mass produced off-the-shelf personal fluid bottle or container, the closure means produces an air tight attachment to the mass produced off-the-shelf personal fluid bottle or container;

each of the said dispensing tube, the internal tube, the piston tube, the closure tube, or the intake tube, or a plurality thereof, has an entrance and exit orifice, wherein;

each of the said dispensing tube, the internal tube, the piston tube, the closure tube, or the intake tube allows personal fluid to flow within it;

a heating means to heat the personal fluid within said dispensing tube, or the internal tube, or the piston tube, or the closure tube, or the intake tube or the plurality thereof, as the personal fluid flows within, wherein;

the heating means is on or about or within or itself any or all of the said intake tube, the transfer tube, the closure tube, the piston tube, the push actuator internal tube, or the dispensing tube;

a power source, wherein;

the power source provides voltage and current to the heating means;

an adjustment control device to control the heating means, wherein;

the adjustment control device which communicates to and is in electrical contact with the power source which communicates to and is in electrical contact with the heating means;

the adjustment control device communicates to the power source a user temperature setting to influence the heating means to induce a same temperature within the personal fluid;

a plurality of sensors wherein;

the plurality of sensors communicates to and is in electrical contact with the power source;

the plurality of sensors communicates to and is in electrical contact with the adjustment control device;

the plurality of sensors determines if fluid is present, if the universal closure means has an air tight closure to the bottle or container, if the actuator has begun a downward compression, if fluid is in motion through a tube, if the heating means has malfunctioned, if the power source is in contact with water or fluid, if heating of the fluid has commenced, and the temperature of the fluid as it exits the dispensing tube;

the said plurality of sensors being numbered one, two, three, four, five, six, seven and eight;

the personal fluid flow path, in order, comprising;

the perforated intake tube, the transfer tube, the closure tube, the piston tube, the push actuator internal tube, and the dispensing tube, wherein;

the personal fluid is urged along and within the personal fluid flow path as a result of depressing the hand-operated push actuator in a downward direction.

2. The replaceable hand-operated pump heating dispenser for the heating of personal fluid as in claim 1, wherein the plurality of sensors includes the first sensor atop the push actuator to sense touch of the user.

3. The replaceable hand-operated pump heating dispenser for the heating of personal fluid as in claim 1, wherein the plurality of sensors includes the second sensor within the dispensing tube to sense fluid presence.

4. The replaceable hand-operated pump heating dispenser for the heating of personal fluid as in claim 1, wherein the plurality of sensors includes the third sensor within the dispensing tube to sense personal fluid temperature.

5. The replaceable hand-operated pump heating dispenser for the heating of personal fluid as in claim 1, wherein the plurality of sensors includes the fourth sensor within the closure tube to sense personal fluid flow rate.

6. The replaceable hand-operated pump heating dispenser for the heating of personal fluid as in claim 1, wherein the plurality of sensors includes the fifth sensor within the universal closure means to sense air tight closure attachment to an off-the-shelf bottle or container.

7. The replaceable hand-operated pump heating dispenser for the heating of personal fluid as in claim 1, wherein the plurality of sensors includes the sixth sensor within the intake tube to detect personal fluid presence.

8. The replaceable hand-operated pump heating dispenser for the heating of personal fluid as in claim 1, wherein the plurality of sensors includes the seventh sensor at the power source to detect a malfunction of the heating means.

9. The replaceable hand-operated pump heating dispenser for the heating of personal fluid as in claim 1, wherein the plurality of sensors includes the eighth sensor at the power source to detect water or fluid in electrical communication with the electrical connection to prevent an electrical shock.

10. The replaceable hand-operated pump heating dispenser for the heating of personal fluid as in claim 1, wherein the fluid flow path is in fluid communication with the personal fluid within the off-the-shelf bottle or container when inserted into the bottle or container containing the personal fluid.

11. The replaceable hand-operated pump heating dispenser for the heating of personal fluid as in claim 1, wherein the adjustment control device is positioned on a remote power source not in physical contact with the dispenser.

12. The replaceable hand-operated pump heating dispenser for the heating of personal fluid as in claim 1, wherein the adjustment control device is positioned onto and in physical contact with the dispenser.

13. The replaceable hand-operated pump heating dispenser for the heating of personal fluid as in claim 1, wherein the intake tube is 50% perforated along its length to allow the user to snap off unwanted portion(s) of the intake tube so as to allow the intake tube to equal the internal depth of the plurality of off-the-self bottles or containers when the dispenser is inserted into the off-the-shelf bottle or container.

14. The replaceable hand-operated pump heating dispenser for the heating of personal fluid as in claim 1, wherein the universal closure means to attach the dispenser to the plurality of off-the-shelf plastic bottles or containers is a screw closure, a snap closure, or a plug closure, which secures an air tight fit onto the off-the-shelf bottle or container.

15. The replaceable hand-operated pump heating dispenser for the heating of personal fluid as in claim 1, wherein the power source is a remote, not in physical contact with the dispenser, which inserts into any AC outlet.

16. The replaceable hand-operated pump heating dispenser for the heating of personal fluid as in claim 1, wherein the power source is a rechargeable battery and is on and in physical contact with the dispenser.

17. The replaceable hand-operated pump heating dispenser for the heating of personal fluid as in claim 1, wherein the power source is internal to the dispenser and power is made by the use of a coil passing about a magnet.

18. The replaceable hand-operated pump heating dispenser for the heating of personal fluid as in claim 1, wherein the power source is internal to the dispenser and power is made by the use of the downward action of the piston tube striking a piezoelectric-element.

19. The replaceable hand-operated pump heating dispenser for the heating of personal fluid as in claim 1, wherein by the user downward pressure onto the push actuator, personal fluid is urged from the transfer tube into the closure tube, which urges the personal fluid from the closure tube into the piston tube, which urges the personal fluid from the piston tube into the push actuator internal tube, which urges the personal fluid from the push actuator internal tube into the dispensing tube, which urges the personal fluid out from the dispensing tube onto the user's hand or body.

20. The replaceable hand-operated pump heating dispenser for the heating of personal fluid as in claim 1, wherein by the user release of the downward pressure onto the push actuator, the transfer ball of the transfer tube is raised from its sealing position within the transfer tube, allowing personal fluid to be urged from the personal fluid bottle or container into the intake tube, which is urged forward into the transfer tube, replacing the personal fluid within the transfer tube which was previously dispensed by the user's downward pressure onto the actuator.

* * * * *